United States Patent [19]

O'Neill

[11] Patent Number: 4,684,294

[45] Date of Patent: Aug. 4, 1987

[54] RETAINING WALL CONSTRUCTION ELEMENT

[76] Inventor: Raymond J. O'Neill, 3 Garmany Pl., Yonkers, N.Y. 10710

[21] Appl. No.: 819,127

[22] Filed: Jan. 15, 1986

[51] Int. Cl.[4] ..... E02D 5/00

[52] U.S. Cl. ..... 405/286; 405/273; 405/284

[58] Field of Search ..... 405/284, 285, 286, 287, 405/273, 272, 258

[56] References Cited

U.S. PATENT DOCUMENTS

| | | | |
|---|---|---|---|
| 982,698 | 1/1911 | Upson | 405/287 |
| 1,702,610 | 2/1929 | Mimaki et al. | 405/286 |
| 1,953,005 | 3/1934 | Nagel | 405/273 |
| 3,877,234 | 4/1975 | O'Neill | 405/273 |
| 4,067,166 | 1/1978 | Sheahan | 405/284 X |
| 4,196,161 | 4/1980 | Toffolon et al. . | |
| 4,269,537 | 5/1981 | O'Neill . | |
| 4,380,409 | 4/1983 | O'Neill | 405/284 X |
| 4,384,810 | 5/1983 | Neumann | 405/284 |

FOREIGN PATENT DOCUMENTS

| | | | |
|---|---|---|---|
| 2286243 | 4/1976 | France | 405/286 |
| 2409351 | 7/1979 | France | 405/284 |
| 0085426 | 5/1982 | Japan | 405/284 |
| 0607891 | 5/1978 | U.S.S.R. | 405/284 |

*Primary Examiner*—Dennis L. Taylor

*Attorney, Agent, or Firm*—Hopgood, Calimafde, Kalil, Blaustein & Judlowe

[57] ABSTRACT

A cast concrete construction element particularly suitable for use in constructing a retaining wall for a soil mass. The construction element includes a face panel in the form of a rectangular prismatic solid. Extending rearwardly from the face panel is an embedment beam which will extend into and engage firmly with the soil mass. The embedment beam includes a sloping rearward wall to penetrate the soil mass, pan inserts and grooves to increase frictional resistance with the soil mass. The embedment beam also includes notches for interengagement with support beams in the soil mass. The embedment beam may take a variety of configurations which may be used to construct differing retaining wall arrays.

15 Claims, 13 Drawing Figures

RETAINING WALL CONSTRUCTION ELEMENT

BACKGROUND AND SUMMARY OF THE INVENTION

This invention relates generally to a cast concrete construction element and particularly to a construction element for use in constructing a retaining wall.

The size and configuration of a cast concrete construction element will vary with the requirements of the job for which it is designed. For for example, construction elements for use in constructing a revetment are disclosed in my U.S. Pat. No. 4,269,537 which was issued on May 26, 1981. Cast concrete construction elements suitable for use in constructing breakwaters are disclosed in my U.S. Pat. No. 4,594,023 issued June 10, 1986. The present invention is directed to a cast concrete construction element, which when disposed in a regular array, is used to form a retaining wall anchored in place by the soil mass to be retained.

In the past, retaining walls have been constructed from arrays of bin like construction elements. These bin like structures have front and rear walls with soil contained within the area between the front and rear walls. See, for example, U.S. Pat. No. 3,877,236 issued Apr. 15, 1975 of which I am a co-inventor. However, the only function the soil mass performs in anchoring the structure is the addition of mass to the bins. Accordingly, it is desirable that the soil mass also serve to anchor the retaining wall. To this end, the present invention is directed to a retaining wall construction element which includes a forwardly disposed rectangular face panel. Extending rearwardly from the face panel is an integral embedment beam which extends into, and is anchored by, the soil mass. The embedment beam includes upper and lower walls, side walls and a sloping rear wall. The embedment beam also includes notches for engagement with transverse support beams which form a soil interruption system to reduce internal pressure and which serve to lock the embedment beams together. The embedment beam further includes pan inserts and a V shaped groove disposed in the sloping rear wall to increase the frictional engagement between the embedment beam and the soil mass.

A retaining wall construction element in accordance with the invention provides a retaining wall in which the soil mass is also utilized to anchor the array of elements in place. Furthermore, this construction element is also lighter and easier to cast than standard bin type retaining wall construction elements. The open rear face of the construction element also permits easier assembly of the retaining wall.

BRIEF DESCRIPTION OF THE DRAWINGS

For a better understanding of the invention, reference is made to the following drawings, to be taken in conjunction with the detailed specification to follow.

DESCRIPTION OF THE PREFERRED EMBODIMENTS

Figure 1:
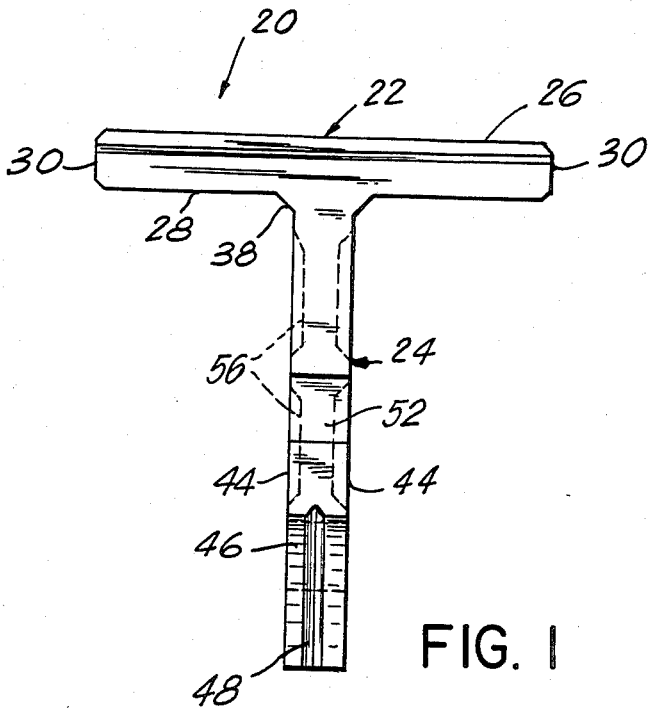
FIG. 1 is a plan view of a retaining wall construction element in accordance with the present invention.
Figure 2:
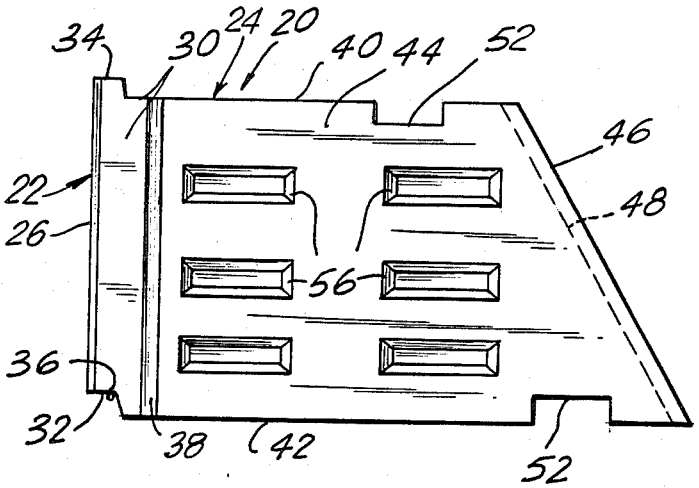
FIG. 2 is a side elevational view of the retaining wall construction element of the present invention.

FIGS. 1 and 2 illustrate a retaining wall construction element 20 in accordance with the present invention. Element 20 comprises a face panel 22 and an integral rearwardly extending embedment beam 24 arranged in a generally T shaped arrangement. Face Panel 22 and embedment beam 24 are integrally cast from concrete either on site or at a manufacturing facility. Face panel 22 includes a forward wall 26, a rearward wall 28, sidewalls 30, a top wall 30 and a bottom wall 32. Upstanding from the forward edge of top wall 30 is a lip 34 for engagement with a corresponding notch 36 in bottom wall 32 of the face panel 22 of another construction element 20.

Figure 3:
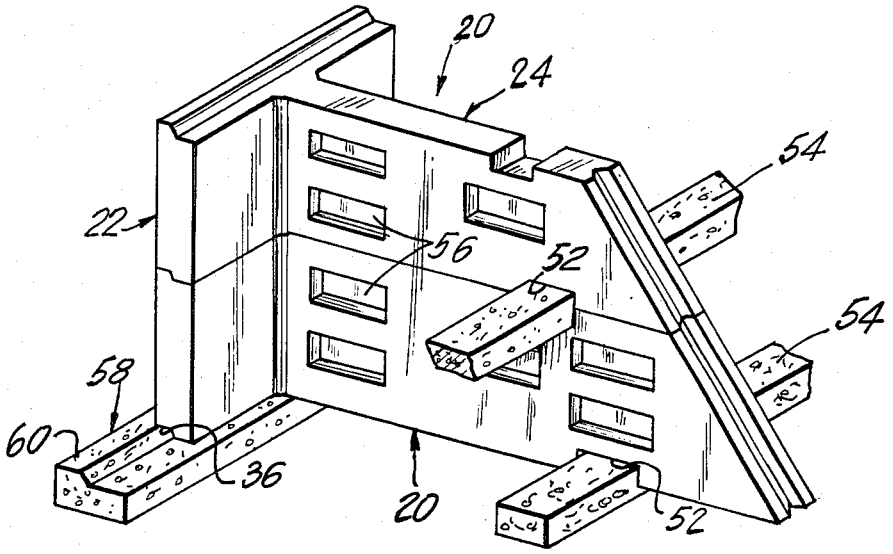
FIGS. 3 and 4 illustrate different array structures for construction of a retaining wall in accordance with the present invention.
Figure 4:
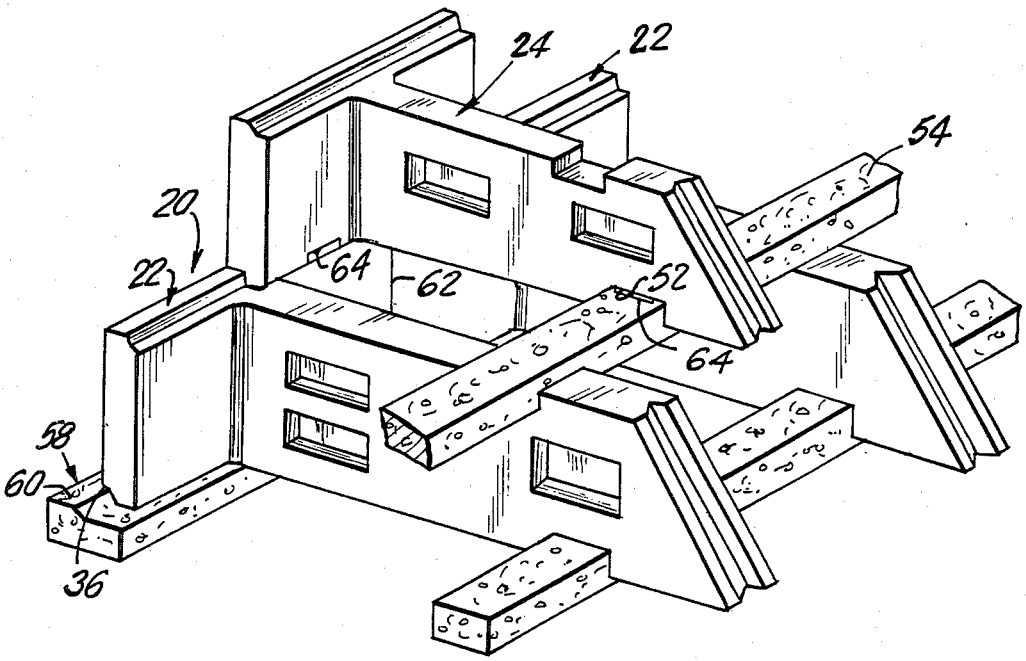

Embedment beam 24 is joined to rear wall 28 of face panel 22 by means of a widened transition portion 38 to reduce stress at the juncture. Embedment beam 24 includes an upper wall 40, a bottom wall 42, side walls 44 and a sloping rearward wall 46 which has a V shaped groove 48 disposed in it. Upper wall 40 and lower wall 42 of embedment beam 24 include notches 52 for engagement with transverse support beams 54 as shown in FIGS. 3 and 4. Side walls 44 include indentations or "pan inserts" 56 which will become filled with compacted earth to anchor element 20 within the soil mass. The length of the embedment beam 24 can be varied in accordance with the job at hand or the array to be constructed. As is discussed below, arrays comprised of elements 20 having various length embedment beams 24 are readily constructed. The friction between the soil mass and element 20 is increased by V shaped groove 48 and pan inserts 56 to securely anchor element 20 in place.

In the remaining drawing figures, like reference numerals have been used to designate like structure. Where the structure differs new reference numerals are used. FIG. 3 illustrates a plurality of retaining wall construction elements 20 in a "stack bonded" array. In such an array the embedment beams 24 are disposed directly atop each other. The lowermost element 20 is mounted above a cast concrete footer 58 which includes an upstanding lip 60 for engagement with notch 36 in face panels 22. Support beams 54 are engaged by notches 52 in embedment beams 24. In site, compacted soil will be packed about embedment beams 24, support beams 54 and pan inserts 56 to securely fasten the retaining wall in place.

The interengagement of support beams 54 with notches 52 forms a "shear key" system to prevent sliding and movement of elements 20. Since the rearward ends of embedment beams 24 extend beyond support beams 54, elements 20 are prevented from turning due to a fulcrum effect. Furthermore, beams 54 form a soil interruption system which reduces internal pressure on the array. It is noted that the pattern of pan inserts 56 in FIGS. 3 and 4 varies from that of FIG. 2, as the number and configuration of the pan inserts may be varied in accordance with the requirements of the soil mass and the retaining wall to be constructed.

FIG. 4 illustrates an array of construction elements 20 disposed in a "brick bonded" pattern in which embedment beams 24 are disposed over the vertical joints 62 formed between adjacent face panels 22. In stacking elements 20, bearing pads 64 may be disposed at the interfaces between construction elements 20 and between notches 52 and support beams 54. Bearing pads 64 serve to distribute the load evenly within the array.

Figure 5:
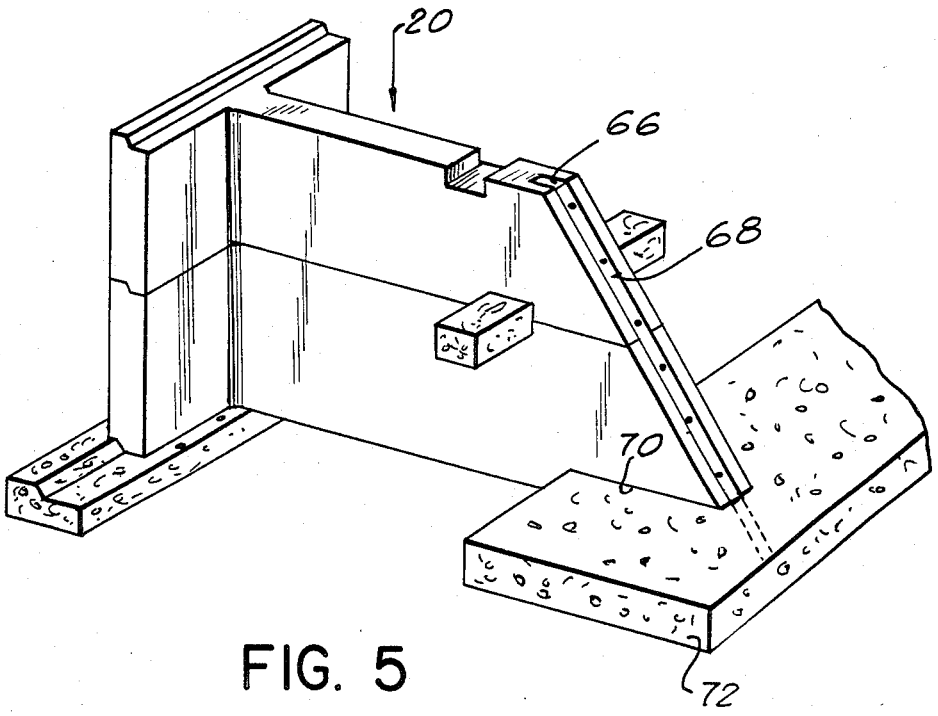
FIGS. 5, 6 and 7 illustrate other embodiments of retaining wall construction elements of the present invention.

FIG. 5 illustrates another embodiment of a retaining wall construction element 20 in which the V shaped groove 48 in sloping wall 46 is replaced by a U shaped groove 66 for receiving a metal strap 68 which is fastened thereto. The lowermost construction element includes a rearwardly extending notch 70 for engagement with a rear footer 72. Metal strap 68 serves both to join construction elements 20 together and to anchor the array to rear footer 72.

Figure 6:
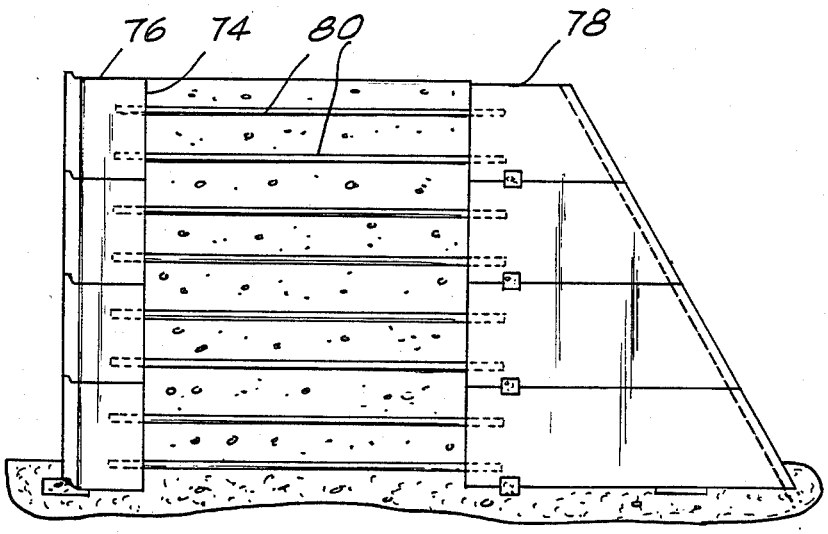

FIG. 6 illustrates another embodiment of the invention which is particularly suitable where the retaining wall to be constructed requires an embedment beam 24 of extreme length. In this embodiment, embedment beam 24 is split along a vertical line 74 into a forward section 76 and a rearward section 78 joined by metal rods or tubes 80. Poured concrete or a soil mass is disposed around tubes 80 and embedment beam 24 to anchor the array in place.

Figure 7:
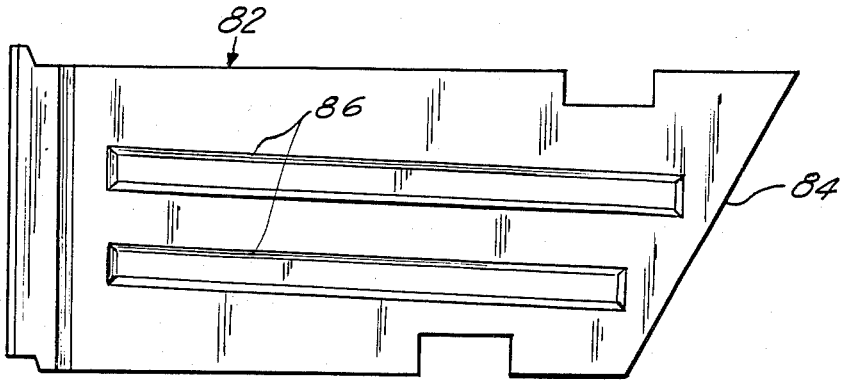
Figure 8:
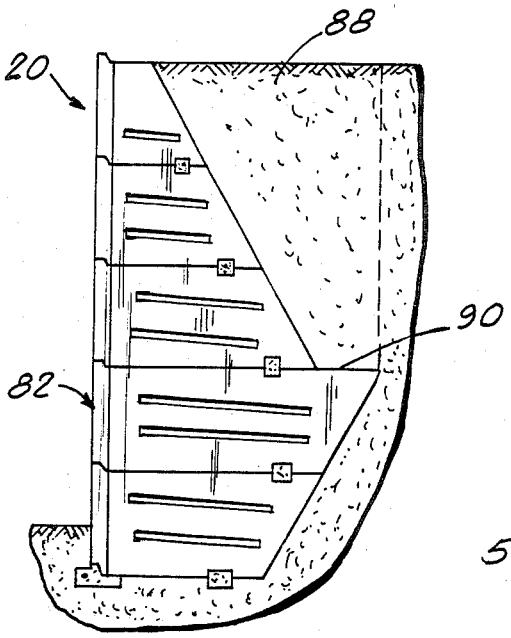
FIGS. 8, 9, 10, 11 and 12 illustrate various arrangements of construction elements used in the construction of retaining walls.
Figure 9:
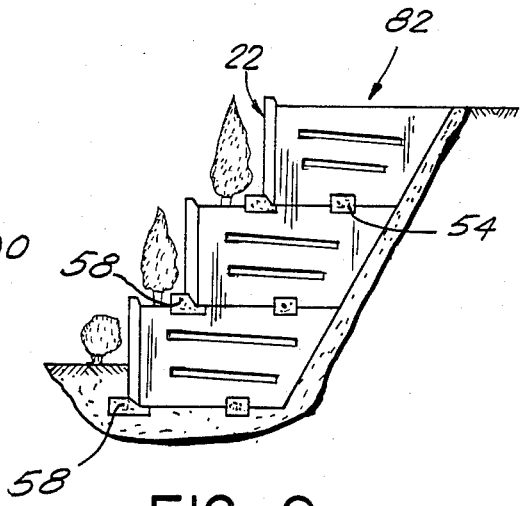

FIG. 7 illustrates another embodiment 82 of a retaining wall construction element which has an embedment beam 24 having a longer top wall so that its rearward wall 84 slopes inwardly rather than outwardly. This embodiment also includes sloping elongated pan inserts 86. As shown in FIG. 8 retaining wall construction elements 82 may be used in an array in conjunction with construction elements 20 of standard configuration. As illustrated, the two lower most construction elements are of the configuration of element 82 while the three upper most elements 20 are of the standard configuration. This array utilizes the upper forward portion 88 of the soil mass to anchor the array, as the soil mass is placed directly above the upper wall 90 of construction element 82. FIG. 9 illustrates another configuration for a retaining wall formed of an array of construction elements 82. In this configuration each face panel 22 is stepped back from the immediately lower face panel. This will permit landscaping elements to be disposed at each step.

Figure 10:
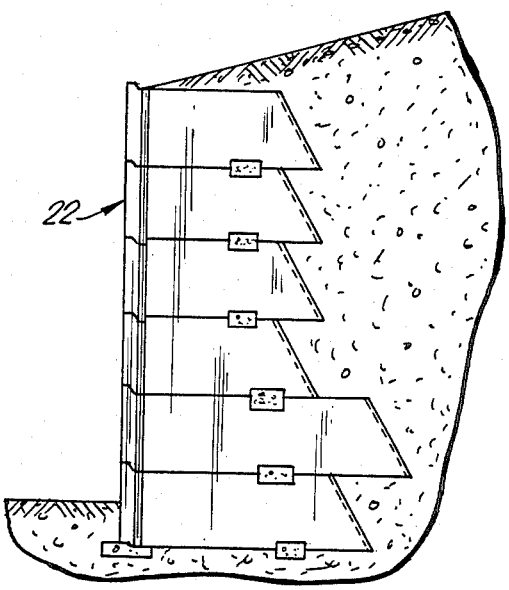
Figure 12:
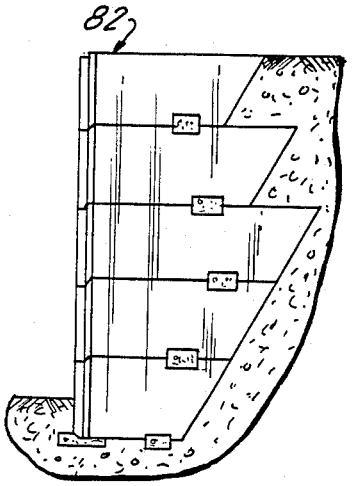
Figure 11:
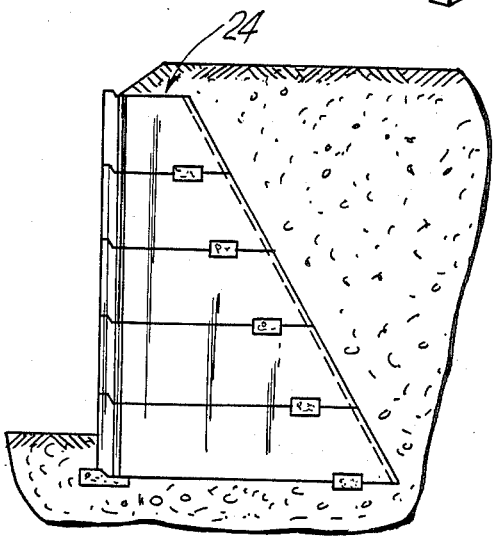

FIGS. 10, 11, and 12 illustrate various ways the construction elements of the present invention may be arranged to form a retaining wall. In FIG. 10 the lengths of embedment beams 22 are varied to form a staggered interface with the soil mass. In FIG. 11 the various length embedment beams 24 are arranged to form a uniformly sloping rearward wall. In FIG. 12 reversed construction elements 82 are arranged with various embedment beam lengths.

Figure 13:
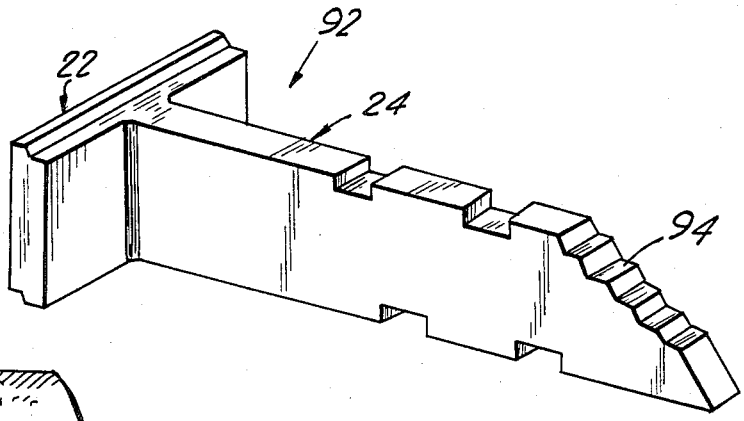
FIG. 13 illustrates yet another embodiment of the retaining wall construction element of the present invention.

FIG. 13 illustrates another embodiment 92 of an embedment beam in which the V shaped groove in rearward wall 46 of embedment beam 24 is replaced by a sawtoothed rearward wall 94. Sawtoothed wall 94 performs the same function as V shaped groove 48, that is, positive engagement of the embedment beam 24 with the soil mass by increased friction.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and the appended claims.

What is claimed is:

1. A retaining wall construction element for retaining a soil mass comprising:
   (a) an upstanding face panel, said face panel being a prismatic solid having a forward wall, a rearward wall, side walls, and a top and bottom wall;
   (b) an embedment beam integrally extending from the rearward wall of said face panel in a generally T shaped arrangement in plan view, said embedment beam being a prismatic solid having an upper wall, a lower wall, side walls, and a sloping rear wall, said embedment beam extending into said soil mass; and
   (c) said embedment beam having soil mass engagement means disposed on at least one of said side walls and said rear wall, said soil mass engagement means providing a frictional engagement between said embedment beam and said soil mass.

2. The retaining wall construction element as claimed in claim 1 wherein said face panel and said embedment beam are integrally cast from concrete.

3. The retaining wall construction element as claimed in claim 1 wherein said soil mass engagement means comprise a V shaped groove disposed in said sloping rear wall of said embedment beam.

4. The retaining wall construction element as claimed in claim 1 wherein said soil mass engagement means comprise a sawtoothed portion disposed on said sloping rearward wall of said embedment beam.

5. The retaining wall construction element as claimed in claim 1 wherein said soil mass engagement means includes indentations in said side walls of said embedment beam.

6. The retaining wall construction element as claimed in claim 1 wherein said upper and lower walls of said embedment beam include notches for receiving transversely disposed support beams.

7. The retaining wall construction element as claimed in claim 1 wherein said top wall of said face panel includes an upstanding lip and said bottom wall of said face panel includes a notch for receiving an upstanding lip of another construction element to thereby permit the interengagement of a plurality of retaining wall construction elements.

8. The retaining wall construction element as claimed in claim 1 wherein said upper wall of said embedment beam is longer than its lower wall and said rearward wall slopes inwardly.

9. The retaining wall construction element as claimed in claim 1 wherein said lower wall of said embedment beam is longer than its upper wall and said rearward wall slopes outwardly.

10. The retaining wall construction element as claimed in claim 1 wherein said embedment beam comprises first and second parts, said first and second parts being joined by rods extending therebetween.

11. The retaining wall construction element as claimed in claim 1 wherein said rearward wall of said embedment beam includes means for receiving strap means to join said embedment beam to a rearwardly disposed footer.

12. A retaining wall for retaining a soil mass, comprising an array of construction elements, each of said construction elements including a face panel in the form of a prismatic solid having a forward wall, a rearward wall and a top and bottom wall, said face panel having means for engagement with other face panels of said array, an embedment beam extending from the rearward wall of said face panel into said soil mass, said embedment beam being a prismatic solid having an upper wall, a lower wall, side walls and transversely disposed support beams, said embedment beam having means for engagement with said transversely disposed support beams and means for frictional engagement with said soil mass disposed on at least one of said side walls and said rear wall.

13. The retaining wall as claimed in claim 12 wherein said sidewalls of said embedment beams include indentations to increase frictional resistance with the soil mass.

14. The retaining wall as claimed in claim 13 wherein said sloping rear wall of said embedment beams includes a groove for engagement with the soil mass.

15. The retaining wall as claimed in claim 12 wherein said array comprises embedment beams of varying lengths.

* * * * *